United States Patent [19]

Ringer et al.

[11] Patent Number: 4,685,271

[45] Date of Patent: Aug. 11, 1987

[54] MEDICATION PACKAGING AND DISPENSING SYSTEM

[75] Inventors: Donald A. Ringer, Goodland, Ind.; Michael R. Greco, Oak Brook, Ill.

[73] Assignee: Drug Package, Inc., O'Fallon, Mo.

[21] Appl. No.: 824,060

[22] Filed: Jan. 30, 1986

[51] Int. Cl.[4] ..... B65B 5/06; B65B 39/06

[52] U.S. Cl. ..... 53/246; 53/390

[58] Field of Search ..... 53/246, 247, 390, 559, 53/453, 467

[56] References Cited

U.S. PATENT DOCUMENTS

| | | | |
|---|---|---|---|
| 2,742,749 | 4/1956 | McGuire | 53/390 X |
| 3,347,016 | 10/1967 | Silverman | 53/246 |
| 3,435,589 | 4/1969 | Horton | 53/390 |
| 3,461,643 | 8/1969 | Strand | 53/390 X |
| 3,545,164 | 12/1970 | Middleton | 53/247 X |
| 3,657,857 | 4/1972 | De Woskin et al. | 53/559 X |
| 3,794,088 | 2/1974 | Harvey | 53/390 X |
| 3,848,395 | 11/1974 | Totten | 53/390 X |
| 4,026,091 | 5/1977 | Pearson | 53/247 X |

*Primary Examiner*—Horace M. Culver

*Attorney, Agent, or Firm*—Laff, Whitesel, Conte & Saret

[57] ABSTRACT

A packaging and dispensing system for pills and like objects includes a rectangular, box-like housing preferably made of metal or other durable material. On the floor of the housing is a sliding template which is equipped with three or more spaced-apart parallel rails to receive between them the rows of blisters on a fold-over drug card. A second, removable template provided with a plurality of holes is superimposed over the sliding template to create a space between the second template and the tops of the rails to receive the fold-over card. The fold-over drug card is inserted between the two templates through an opening at one end of the housing and positioned so that the blisters in the card are not aligned with the holes in the upper template. A spreader is used to spread the pills along the length of the second template, dropping one or more pills into each hole in the second template. When each hole is filled, the drug card is pulled out of the housing thereby aligning the blister cavities in the card with the holes in the upper template and enabling the pills to fall into the blister cavities. The card is then removed, folded over, heat sealed and labeled.

12 Claims, 9 Drawing Figures

MEDICATION PACKAGING AND DISPENSING SYSTEM

BACKGROUND OF THE INVENTION

This invention relates to pharmacist's tools for filling packages and dispensers and more particularly to dispensers of drugs in the form of pills, capsules, tablets and the like, hereinafter generically called "pills".

Generally, a pharmacist fills a prescription by hand, counting the prescribed number of pills and putting them in bottles with labels. Another form for packaging pills involves putting the pills into fold-over drug cards which hold a month's or more supply of pills. The fold-over card comprises a backing card with a plurality of holes and a separate blister sheet. In order to fill the fold-over card the blister sheet is placed on the backing card so that the individual blisters or cavities on the blister sheet fit into the plurality of holes on the backing card. The blister sheet and fold-over card are then placed in a sealing tray to hold them in place and one or more pills are placed in each blister or cavity. When the card is filled, the sealing tray, which may hold several cards, is placed in a heat sealing machine and the fold-over card is sealed and subsequently labeled. Such cards are often used in nursing homes and similar institutions where a large number of pills are regularly distributed to long-term residents or patients.

There are some very special and important problems related to the dispensing of drugs in the form of pills. Each pill must be taken on a prescribed schedule, which is generally different from the schedules prescribed for other types of pills. This particularly becomes a problem in the context of hospitals, nursing homes, and the like, where a large number of various kinds of pills are dispensed daily for many individuals, some of whom may be long-term patients. When the number of dispensed pills is large, there may also be a problem of accountability. The person giving the pills should have a quick and easy way of accounting for whether the correct drugs were taken at the correct time.

Another problem with the dispensing of pills is that very often it is done by hand, counting out the pills and placing them in cups, in bottles or in cards. The process of hand counting pills and placing them in correct containers is time consuming and subject to error.

Yet another problem is that the pharmacist must handle each of the pills. Any residue from one drug which is left on the pharmacist's hands may contaminate subsequently handled drugs.

Still another problem that is encountered with the use of fold-over cards is that they cannot be stacked for filling and sealing. Because the blister sheet and backing card are separate pieces, they must be held in place for filling and sealing in a sealing tray. Otherwise, the blister sheet and backing card will separate. Consequently, only a few cards can be sealed at the same time, which is not efficient.

Accordingly, an object of this invention is to provide a new and improved packaging and dispensing system for drugs in pill, capsule or tablet form. Since pills generally come in five standard sizes or shapes, an object is to provide such dispensers with means for dispensing the proper number of pills, regardless of size or shape.

Another object of this invention is to provide a quick and easy means for packaging and dispensing pills, and a means which ultimately gives the person distributing the pills a quick and accurate method of establishing accountability.

Yet another object of this invention relates to costs. A complex packaging system with many moving parts and a complicated work cycle would not be economically practical in many situations such as nursing homes, hospitals and independent pharmacies. Thus, an object is to provide an economical packaging system a pharmacy or druggist can use to package pills in an efficient and cost saving manner.

Still another object is to provide a packaging and dispensing system in which the druggist or pharmacist does not touch the pills or risk contamination of one drug from a previous handling of other drugs.

A further object of the present invention is to provide a packaging and dispensing system which is simple in construction and easy to use and clean.

Yet another object of this invention is to provide a packaging and dispensing system for filling fold-over drug cards so that a relatively large number of cards can be stacked and sealed at one time.

SUMMARY OF THE INVENTION

In keeping with an aspect of this invention, these and other objects are accomplished by providing a rectangular, box-like housing, preferably made of metal or other durable material. A removable template fits on the floor of the housing. The template is equipped with three or more spaced-apart parallel rails to hold between them the blisters or cavities of a fold-over drug card. A second removable template may be made of plastic and is provided with a plurality of holes corresponding to the blisters in the fold-over drug card. This second template is superimposed in the housing over the first template to create a space between the two templates. A stop is located on the underside of the second template away from the rectangular opening in the housing. A fold-over drug card is inserted through a rectangular opening in the housing into the space between the two templates until it contacts the stop on the underside of the second template. A number of pills are placed on the second or upper template and spread along the length of the upper template so that one or more pills drop through each hole in the template. When each hole is filled the card is slowly pulled out of the housing thereby aligning the blister cavities with the upper template holes so that the pills fall neatly into the cavities. The fold over card is then removed, folded over, heat sealed and labeled.

DETAILED DESCRIPTION OF THE INVENTION

Figure 1:
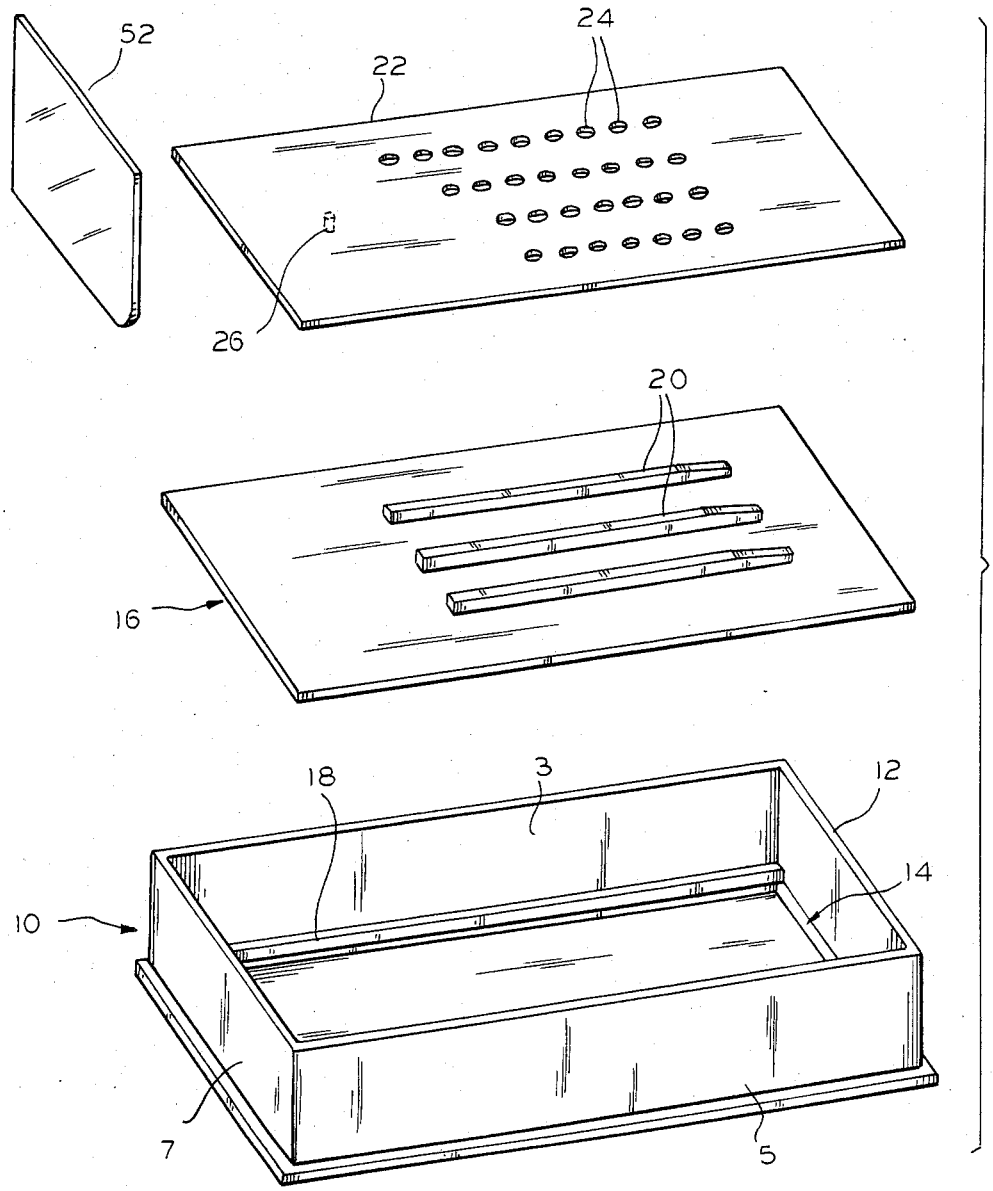
FIG. 1 is an exploded view, in perspective, showing the inventive pill packaging and dispensing mechanism.

As shown in FIG. 1 the inventive packaging and dispensing system comprises a single housing 10 (made of any suitable, durable and cleanable material, such as annodized aluminum) having a floor and four sides (3,5,7,12), and dimensions of approximately 7×18×2 inches, in one embodiment. At one end 12 of the housing 10, and located at or near the bottom, is a rectangular opening 14 which runs across the width of the end 12 of the housing 10.

Figure 3:
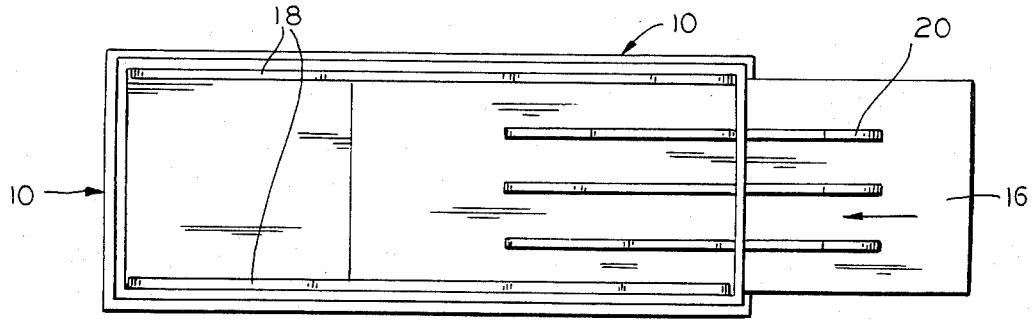
FIG. 3 is a plan view showing a first and lower template, with rails, being inserted into a housing.
Figure 7:
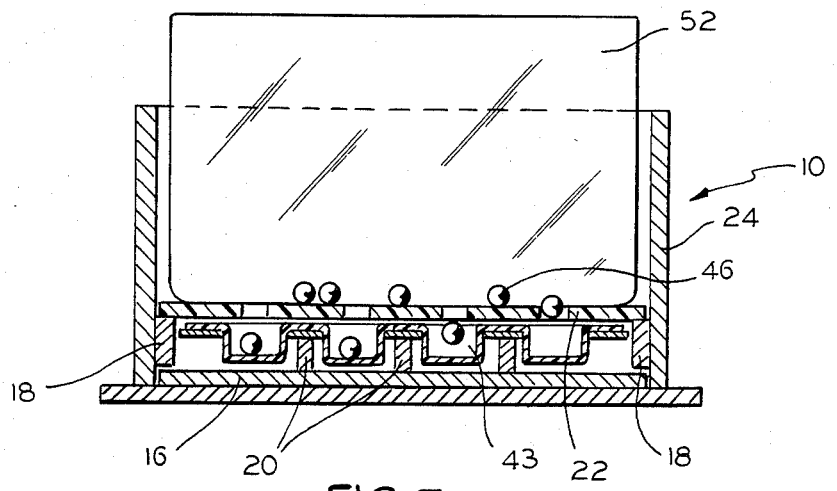

A first or lower removable, sliding template 16 is inserted into the opening 14, somewhat as a drawer, and slides down the length of the floor of the housing (FIG. 3). Template 16 is held in place by an opposing pair of parallel ledges 18 which are located along sides 3,5 of the housing 10. In one embodiment, the sliding template 16 is equipped with three spaced-apart upstanding parallel rails 20 which are located on and secured to its upper surface. These three rails are spaced an equal distance from one another to receive between them the bubbles or blisters of a fold-over drug card as shown in FIG. 7.

A second or upper template 22, (which may be made of opaque or transparent plastic, for example) is lowered from above into the housing 10 where it rests on the housing's side ledges 18. The second template 22 does not contact the parallel rails 20 of the first template 16 so that a space is created between the second template and the top of rails 20. The upper template 22 is provided with a suitable number, such as thirty or more, of holes 24 arranged in parallel rows and positioned in approximately the middle of the upper template 22 to correspond to the blisters 43 in the fold-over drug card 40. The holes are sized to receive and accommodate a particular size and shape pill. A number of different upper templates 22 may be provided with different sized and shaped holes 24 to accommodate pills, tablets and capsules of different sizes and shapes. The underside of the second or upper template 22 is equipped with a dependant pin 26 that acts to stop the excursion of the fold-over card when the card 40 is inserted in the housing 10 between the templates 16, 22. In this position the blisters 43 are not aligned with holes 24 so that when the pills fill the holes 24, they are held outside of the blisters 43.

The thickness of the upper template 22 controls the number of pills that will drop into each blister in the fold-over drug card. If it is desired to fill each blister 43 in the fold-over drug card 40 with one pill, an upper template 22 with a thickness just slightly greater than the thickness of one pill will be used. In this way, each hole 24 in the upper template 22 will be filled by only one pill. If, for example, it is desired to fill each blister with two pills, an upper template 22 with a thickness just slightly greater than the thickness of two pills will be used. The thickness of the upper template 22 can thus be made to any desired dimension to control the number of pills that will fill each blister 43 in the fold-over card 40.

Fold-over drug cards are generally made to hold a 31, 60 or 90 day's supply of medication for a particular individual. Thus, a 31-day card would have 31 separate blisters 43, a 60-day card would have 60 separate blisters 43, and a 90-day card would have 90 separate blisters 43. Of course, a fold-over drug card can be provided with any number of blisters 43 required to hold medication for any desired period of time.

To accommodate fold-over drug cards 40 with different numbers of blisters 43, separate upper templates 22 can be provided with the appropriate number of holes 24 to correspond to the number of blisters 43. Also, separate lower templates 16 can be provided with a varying number of rails 20 spaced apart to accommodate the different configurations of the blisters 43 on the drug cards.

For example, as shown by the embodiment of the invention depicted in FIG. 1, 31 holes 24 are provided in upper template 22 and three rails 20 are provided in lower template 16 to accommodate a fold-over drug card 40 with 31 blisters 43. If it were desired to fill a 60-day drug card, then an upper template 22 with 60 holes and a lower template with five rails 20 would be used (not shown).

Figure 2:
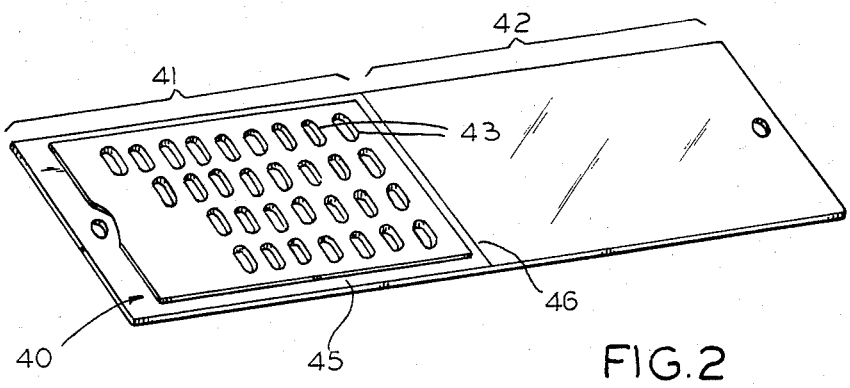
FIG. 2 is a perspective view of a fold over card with a blister package.
Figure 4:
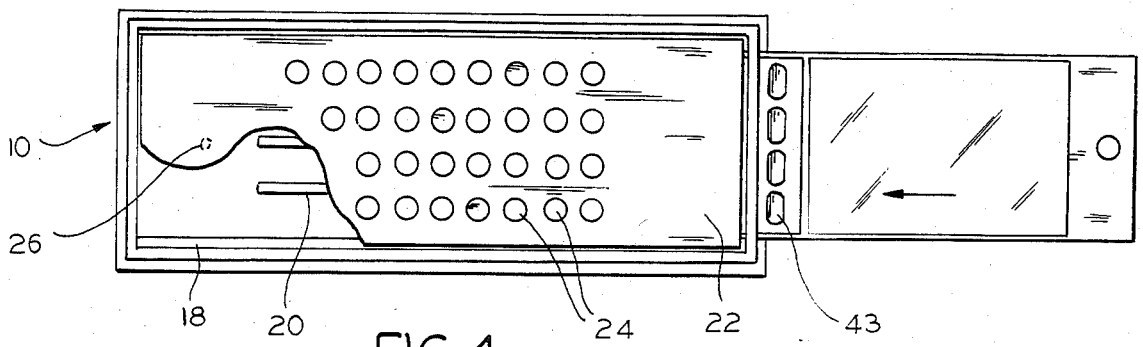
FIG. 4 is a plan view (with a second and upper template partially broken away) showing a fold-over drug card being inserted into the housing.

The fold-over drug card 40 has two parts 41, 42 as shown in FIG. 2. A first part 41 includes an attached blister sheet with a plurality of blisters 43 formed therein which, when viewed in the position shown in FIG. 2, form a plurality of cavities for receiving individual pills. The end 41 of card 40 with the blister sheet is inserted (FIG. 4) into the end opening 14 of the housing 10 and slides over the rails 20 of the lower template 16 until its movement is stopped by the pin 26 on the underside of the upper template 22. At this position, the blisters or cavities 43 in the blister sheet of the fold-over card 40 are under but not precisely aligned with the holes 24 in the upper template 22.

Figure 5:
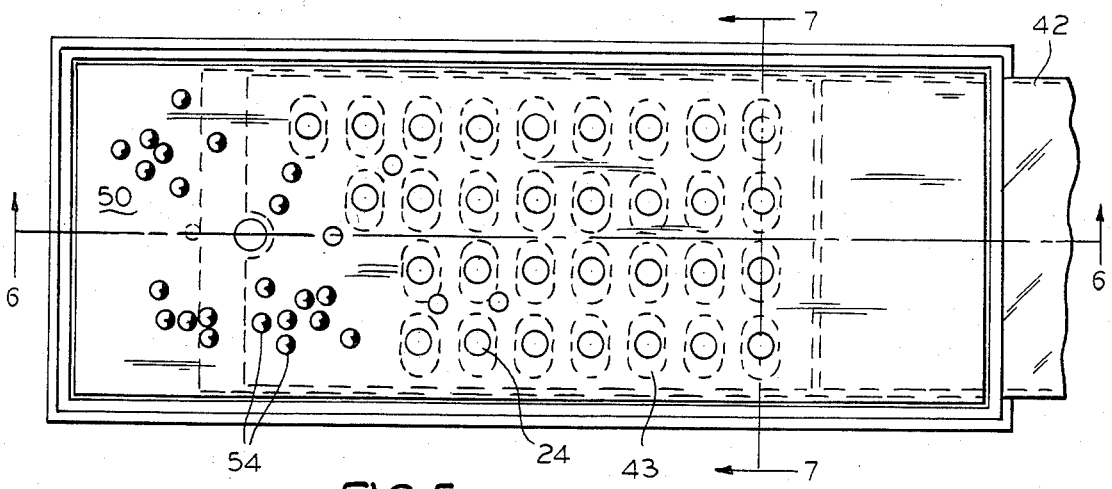
FIG. 5 is a plan view showing the start of a process for filling a fold-over card with pills.
Figure 6:
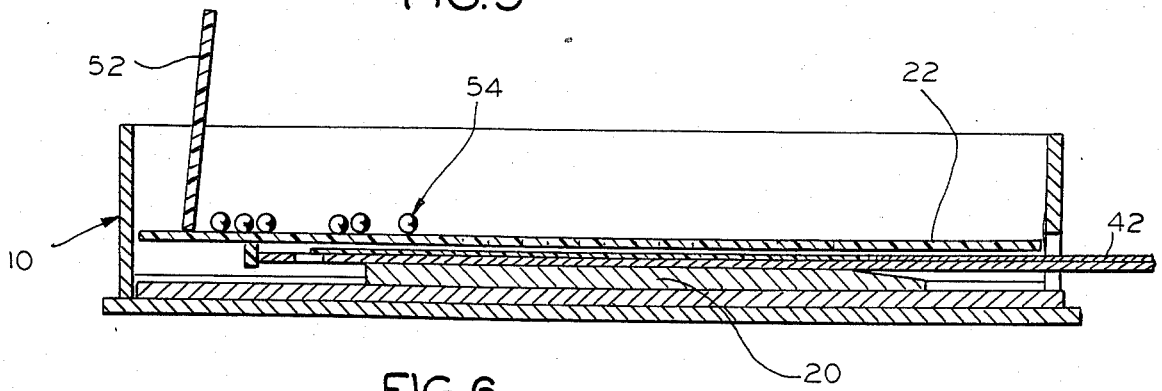
FIG. 6 is a side elevation and FIG. 7 is an end elevation, both in cross section, showing, respectively, the pills being spread along the upper template and dropping into the blisters in the fold-over card as the card is pulled out of the housing.

Pills, tablets, or capsules 54 are poured onto the flat unbroken surface 50 at one end of the upper template 22 away from the holes 24 (FIG. 5). A spreading device 52 is then used to spread the pills 54 and to disperse them down the length of the upper template 22, thus enabling one or more pills to drop into each hole 24, depending on the thickness of template 22 (FIG. 6). Because the blisters or cavities 43 are not in register or precisely aligned with the holes 24 of the upper template 22, the pills are retained in holes 24 and do not drop down into the blisters or cavities 43. When every hole 24 is properly filled, the protruding end 42 of the fold-over card is pulled gently outward from the housing 10, causing the blisters or cavities 43 to move into precise alignment with holes 24 and allowing the pills in the holes 24 to drop into the cavities 43 as shown in FIG. 7.

Figure 8:
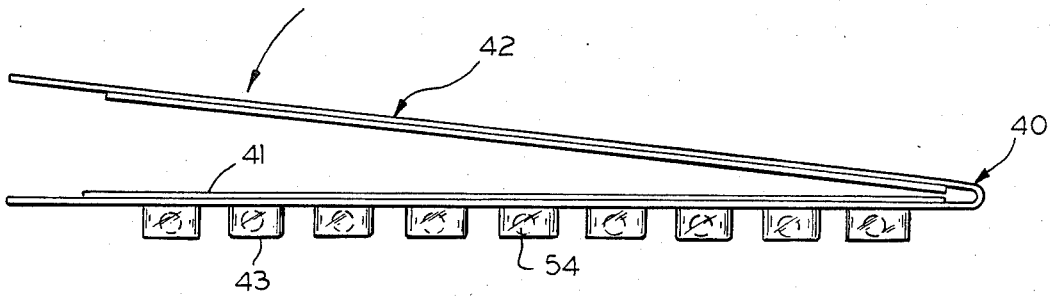
FIG. 8 is a side elevation of the fold-over card being placed in a condition for sealing.
Figure 9:
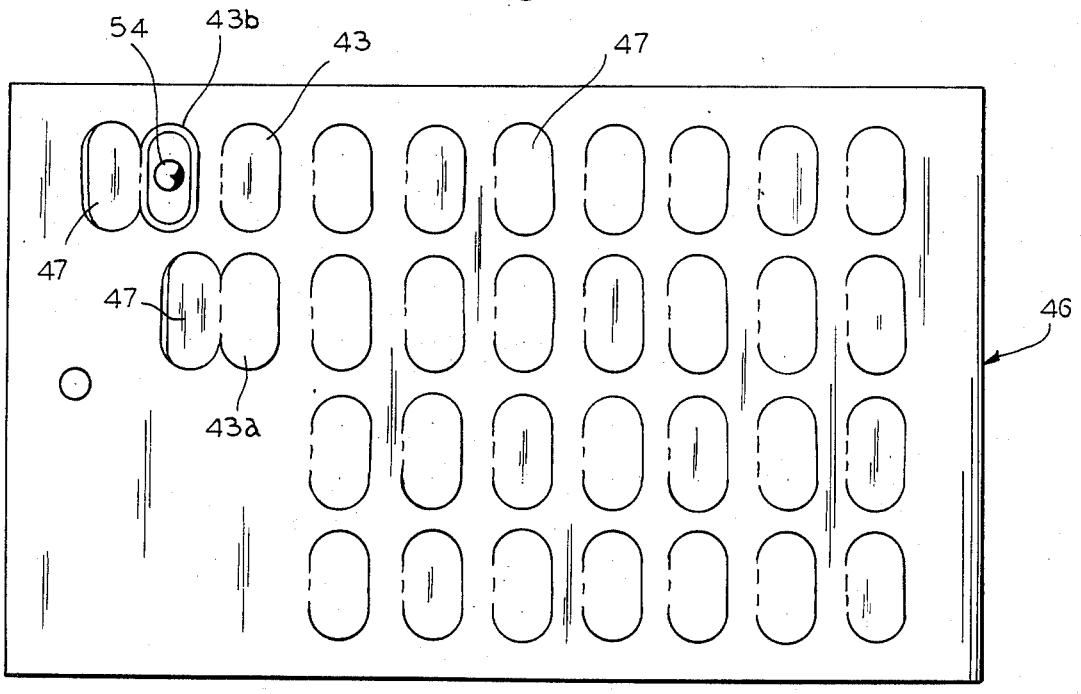
FIG. 9 is a plan view of a completed fold-over card with two blisters having been opened, one of which still contains a pill.

When the pills are thus in place in the blisters or cavities 43, the drug card is removed, folded over (FIG. 8), and heat sealed (FIG. 9). The cardboard frame 45 folds along line 46, so that panel 42 is positioned over the blister sheet containing the blisters or cavities 43. Card 40 is then sealed on conventional machines so that every cavity 43 becomes a sealed package containing one or more pills. Panel 42 is provided with a plurality of perforated punch-out portions 47 that correspond to each blister 43 so that when panel 42 is folded over behind panel 41, a single perforated punch-out portion 47 is aligned with a blister 43. This provides an easy means for removing the pills from the individual blisters 43 as desired.

For example, as shown in FIG. 9, two perforated parts 47 of panel 42 have been torn open, and a pill has been removed from blister 43*a*. Pill 54 remains in open blister 43*b*. The rest of the cavities in FIG. 9 remain sealed.

It is contemplated that a pharmacist using the inventive system may employ several sets of lower and upper templates 16, 22 to accommodate different sized and shaped pills and fold-over drug cards with different numbers of blisters. The inventive system thus provides a very economical and efficient way to fill fold-over drug cards with medication. Moreover, because of the simplicity of construction and operation, the inventive system is particularly easy to keep clean, an important feature in dispensing drugs.

Those who are skilled in the art will readily perceive how to modify the invention. Therefore, the appended claims are to be construed to cover all equivalent structures which fall within the true scope and spirit of the invention.

We claim:

1. A system for packaging and dispensing pills or like objects into a plurality of cavities in a container, said system comprising a box-like housing with a first opening at the top and a second opening in a lower portion of the housing, a lower template adapted to be removably inserted into the housing through the second opening to position said container in the housing, a second template superimposed over the lower template, means for holding apart said lower and second templates with a space between them while in said housing to receive said container in said space, said second template having a number of holes of a size to receive a predetermined number of pills, said holes being positioned over the cavities in said container, and a means for spreading the pills along the second template to fill the holes as the pills are swept along the second template.

2. The packaging and dispensing system of claim 1 including a means for positioning the container in a first position in the housing to locate the cavities in the container partially underneath, but not precisely aligned with, the holes in the second template so that when each of said holes contains a pill the pill will not fall into a cavity in the container until the container is moved from said first position.

3. The packaging and dispensing system of claim 1 wherein said second opening in the lower portion of said housing enables the container to be slidably inserted into the space between said templates.

4. The packaging and dispensing system of claim 1 wherein the housing is rectangular and two ledges run along the inner surface of the longer sides of said rectangle, the lower template resting below and the second template resting above said ledges.

5. The packaging and dispensing system of claim 1 wherein the lower template has longitudinally extending, spaced-apart parallel rails for receiving between them the cavities of said container when the container is placed in the space between the two templates.

6. The packaging and dispensing system of claim 2 wherein said means for positioning the container is a pin protruding from the underside of the second template.

7. The packaging and dispensing system of claim 1 wherein the container is a blister sheet attached to a fold-over card, said fold-over card having a plurality of holes to receive the blisters on the blister sheet.

8. A tool for packaging and dispensing pills into a plurality of cavities in a blister sheet, said tool comprising a housing which is open at least on the top, a first template disposed in said housing, a second template disposed in said housing and superimposed over the first template, means for holding apart said first and said second templates with a space between them to receive the blister sheet, said second template having a number of holes to receive a predetermined number of pills, upstanding means on said first template for positioning the cavitities of the blister sheet underneath said holes, and a means for spreading the pills along the second template to fill the holes.

9. The tool of claim 8 including means for positioning the blister sheet in the space between said templates so that the cavities in the blister sheet are not in registry with the holes in the second template when the blister sheet is fully inserted into the housing and the pills in the holes will not drop into the cavities until the blister sheet is moved in a direction to remove it from the housing.

10. A system for packaging and dispensing pills or like objects into a plurality of cavities in a container, said system comprising a housing, a template adapted to fit into the housing, means disposed in said housing for supporting said template above and spaced-apart from the bottom of the housing, said template having a number of holes to receive a predetermined number of pills, means disposed in said housing beneath said template for positioning said container in the housing between the template and said positioning means, and a means for spreading the pills along the length of the template to fill the holes.

11. The system of claim 10 wherein said means for positioning said container includes a plurality of longitudinally extending, spaced-apart parallel rails extending upwardly toward said template to define a space between the top of the rails and the template.

12. The system of claim 10 including means disposed in said housing for locating the cavities in the container partially underneath, but not precisely aligned with, the holes in the template so that when each of said holes contains a pill the pill will not fall into the cavities in the container until the container is moved in a direction to remove it from the housing.

* * * * *